US011158449B2

(12) United States Patent
De Lucia et al.

(10) Patent No.: US 11,158,449 B2
(45) Date of Patent: Oct. 26, 2021

(54) METHOD AND DEVICE FOR MANUFACTURING TRANSFORMERS WITH A CORE MADE OF AMORPHOUS MATERIAL, AND TRANSFORMER THUS PRODUCED

(71) Applicant: Guglielmo Montagnani, Casole d'Elsa (IT)

(72) Inventors: Maurizio De Lucia, Prato (IT); Matteo Messeri, Bagno a Ripoli (IT)

(73) Assignee: Guglielmo Montagnani, Casole d'Elsa (IT)

( * ) Notice: Subject to any disclaimer, the term of this patent is extended or adjusted under 35 U.S.C. 154(b) by 996 days.

(21) Appl. No.: 15/557,243

(22) PCT Filed: Mar. 11, 2016

(86) PCT No.: PCT/EP2016/055243
§ 371 (c)(1),
(2) Date: Sep. 11, 2017

(87) PCT Pub. No.: WO2016/142504
PCT Pub. Date: Sep. 15, 2016

(65) Prior Publication Data

US 2018/0061549 A1 Mar. 1, 2018

(30) Foreign Application Priority Data

Mar. 12, 2015 (IT) ..... FI2015A000071

(51) Int. Cl.
*H01F 27/24* (2006.01)
*H01F 27/25* (2006.01)
(Continued)

(52) U.S. Cl.
CPC ..... *H01F 27/25* (2013.01); *H01F 30/10* (2013.01); *H01F 30/12* (2013.01); *H01F 41/022* (2013.01); *H01F 41/0226* (2013.01)

(58) Field of Classification Search
USPC ..... 336/216–218
See application file for complete search history.

(56) References Cited

U.S. PATENT DOCUMENTS 4,655,407 A * 4/1987 Rechsteiner ..... H01F 41/022 242/434.1
6,683,524 B1 1/2004 Hoeglund
(Continued)

FOREIGN PATENT DOCUMENTS

EP 1 110 227 B1 3/2010
EP 1 277 217 B1 4/2010
(Continued)

OTHER PUBLICATIONS

English abstractor JP359054213 (Year: 1984).*

*Primary Examiner* — Ronald Hinson
(74) *Attorney, Agent, or Firm* — McGlew and Tuttle, P.C.

(57) ABSTRACT

A device for the production of a transformer is disclosed, comprised of at least two electrically conductive windings (A, B, C) adjacent to one another, and a ferromagnetic core (11; N2; N3) linked to the two electrically conductive windings, formed by wound strip-shaped ferromagnetic material. The device comprises guide members (9) configured and arranged so as to define a closed path linked to the two electrically conductive windings, along which one or more strip-shaped ferromagnetic materials can be wound from at least one coil (R; R1-R18).

16 Claims, 15 Drawing Sheets

(51) Int. Cl.

| | |
|---|---|
| ***H01F 30/10*** | (2006.01) |
| ***H01F 30/12*** | (2006.01) |
| ***H01F 41/02*** | (2006.01) |

(56) References Cited

U.S. PATENT DOCUMENTS

| | | | | |
|---|---|---|---|---|
| 8,373,529 | B2 | 2/2013 | Hurst et al. | |
| 2012/0062351 | A1 | 3/2012 | Theisen et al. | |
| 2013/0088314 | A1* | 4/2013 | Francoeur | H01F 27/30 336/65 |
| 2013/0200967 | A1 | 8/2013 | Xu et al. | |
| 2013/0219700 | A1* | 8/2013 | Hurst | H01F 27/263 29/605 |
| 2014/0097286 | A1 | 4/2014 | Francoeur et al. | |
| 2015/0050510 | A1* | 2/2015 | Motegi | C22C 45/02 428/544 |

FOREIGN PATENT DOCUMENTS

| | | | |
|---|---|---|---|
| EP | 2 395 521 | A1 | 12/2011 |
| GB | 2 001 479 | A | 1/1979 |
| GB | 2283864 | A | 5/1995 |
| JP | S62 176117 | A | 8/1987 |
| WO | 0014753 | A1 | 3/2000 |
| WO | 0165572 | A2 | 9/2001 |

* cited by examiner

Fig.12B
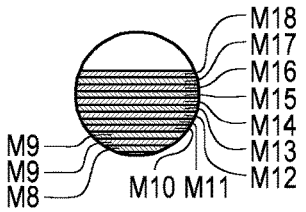
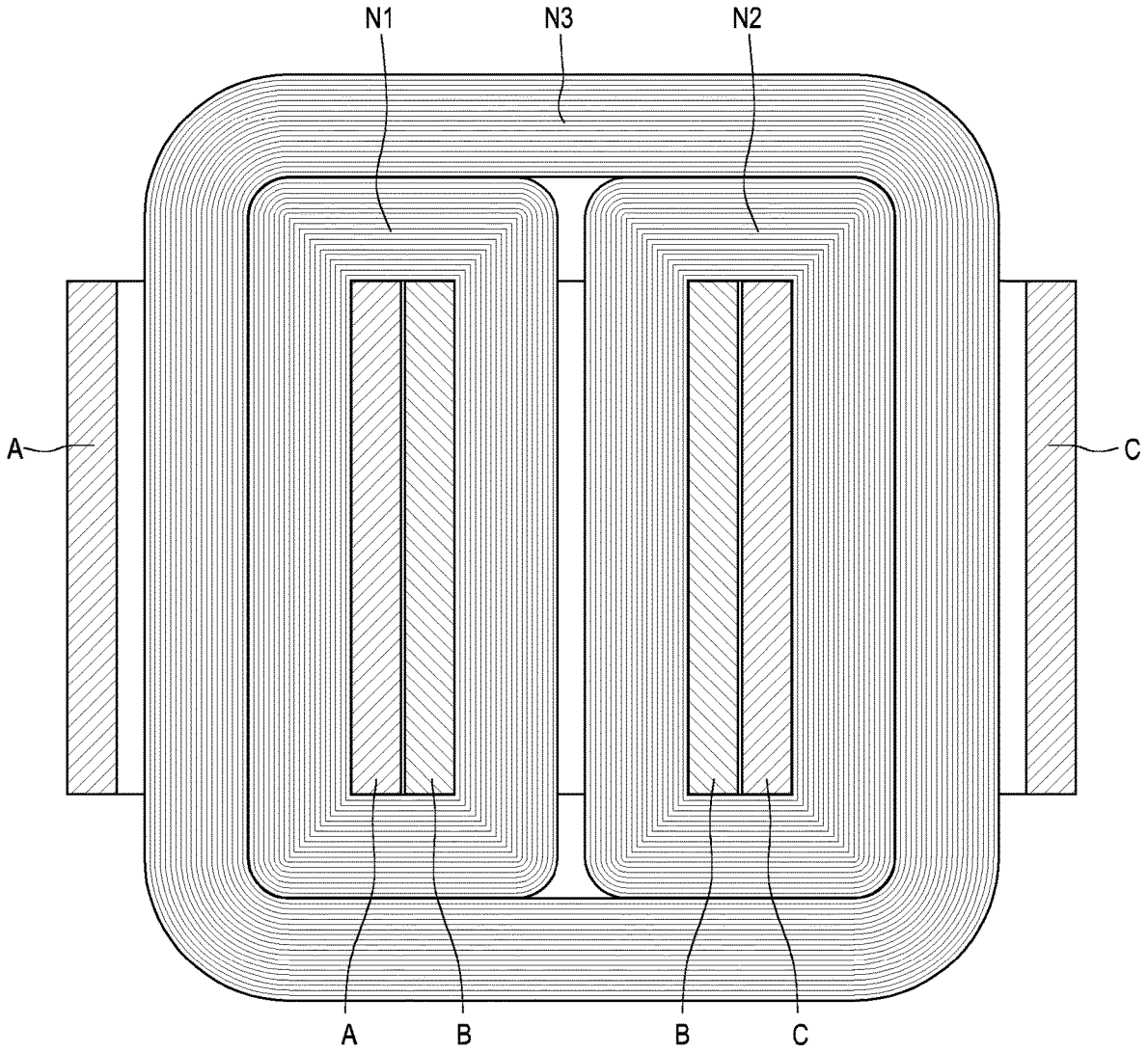
Fig.12A

METHOD AND DEVICE FOR MANUFACTURING TRANSFORMERS WITH A CORE MADE OF AMORPHOUS MATERIAL, AND TRANSFORMER THUS PRODUCED

FIELD OF THE INVENTION

The present invention relates to equipment and methods for manufacturing electrical transformers. In particular, the present invention relates to improvements to methods and devices for manufacturing continuous ferromagnetic cores, for example by using strips of amorphous metal.

BACKGROUND ART

Transformers are electrical devices, which take electricity at a voltage level and change it into electricity at another voltage level. Transformers are typically used, for instance, in high to-medium voltage transformer substations and in medium-to-low voltage transformer substations. Generally speaking, a transformer is comprised of a plurality of windings made of strip-shaped or wire-shaped electrically conductive material, wound around one or more ferromagnetic cores. The ferromagnetic cores usually have columns, around which the electrically conductive windings are wound, and yokes joining the columns together, thus ensuring the continuity of the magnetic circuit defined by the core.

In typical three-phase transformers, ferromagnetic cores with three columns are provided, around which the primary winding and the secondary winding of each phase are wound. According to known techniques, the ferromagnetic core is made of laminations stacked over one another and electrically insulated from one another, so as to reduce losses due to parasitic currents. Laminations packs are joined to one another at joining points between yokes and columns. In these areas high losses occur due to the discontinuity given by the edges of the stacked laminations.

The assembling of ferromagnetic cores according to this technique is highly time-consuming, due to the high number of laminations forming the core. The laminations used for manufacturing this kind of ferromagnetic cores are usually made of an iron-carbon alloy, with a grain-oriented structure.

Recently, a different transformer manufacturing technique has been developed, wherein the core is made of an amorphous metal (amorphous metal distribution transformer, AMDT). Amorphous metals are iron alloy containing boron instead of carbon, this latter being used for the grain-oriented ferromagnetic laminations. This technique has been developed since the '70s. It uses very thin strips of amorphous metal manufactured by quick solidification of the melt. The thickness of the strip shall be very low, in order to achieve sufficiently high cooling speeds to keep the amorphous structure of the material even after solidification.

The amorphous structure of the material allows significant reduction of the magnetization work compared with the traditional transformers. This results in a very small hysteresis area and, thus, in very low relative losses. The low thickness and the high resistivity of the amorphous metal allow also significant reduction of losses due to parasitic currents. The ferromagnetic cores made of amorphous metal have therefore core losses which are significantly lower than transformers with traditional laminations, and this results in significantly lower electricity consumption.

However, due to the very nature of the amorphous material, significant technological problems occur in core manufacturing. Manufacturing processes have been developed, wherein the strip is wound so as to form one or more coils that are subsequently consolidated, by means of polymerizable thermoset resins, to form the final core. Then, the electrically conductive windings are wound around the core columns. US2013/0200967, U.S. Pat. No. 8,373,529, US2013/0219700, U.S. Pat. No. 6,683,524, EP2,395,521, EP1,110,227, EP1,277,217 disclose examples of transformers with cores made by means of a continuous strip of amorphous metal.

The winding of the conductors around the core is very complex and has technological restrictions since it is impossible to wind them with enough traction.

GB-A-2283864 discloses a method for manufacturing two-phase transformers comprised of two electrically conductive windings and a ferromagnetic core. The two electrically conductive windings are manufactured separately and are then moved towards each other, so that the respective columns are adjacent to each other. A winding reel is provided around the two adjacent columns of the electrically conductive windings; then, the ferromagnetic core is formed around the reel, by winding a single strip of ferromagnetic material. In some embodiments the ferromagnetic core is formed by winding in sequence, one after the other, several strips of ferromagnetic material of decreasing width. The strips of ferromagnetic material are wound one after the other, so that a second strip of ferromagnetic material is entirely wound outside a coil formed by a first strip of previously wound ferromagnetic material.

The method described in GB-A-2283864 has many limits and drawbacks. Namely, the product obtained with this method is not economically optimized and is poorly efficient from an electric viewpoint, as the ferromagnetic core has a circular cross-section requiring the use of electrically conductive windings of wide internal section. Furthermore, the circular cross-section implies many empty spaces around the electrically conductive windings, and it is therefore necessary to use large amount of ferromagnetic material.

A need therefore exists, for new methods and devices for manufacturing transformers provided with cores made of strip-shaped ferromagnetic material, in particular of amorphous metal.

SUMMARY OF THE INVENTION

According to a first aspect, a method for manufacturing transformers is described, comprising the following steps: providing at least a first electrically conductive winding and a second electrically conductive winding; moving the first electrically conductive winding and the second electrically conductive winding towards each other; forming a first ferromagnetic core linked to the first electrically conductive winding and to the second electrically conductive winding, by winding at least one strip-shaped ferromagnetic material according to a closed path linking the first electrically conductive winding and the second electrically conductive winding.

The strip of ferromagnetic material is wound using at least one coil of ferromagnetic material moving along a closed path, linked to the electrically conductive windings.

With the method according to the invention, a more compact, more economical and more efficient transformer is provided by means of a mechanized process, without the need of manual assembly, thus reducing the transformer overall cost.

According to embodiments described herein, the method comprises the steps of:

moving at least two previously formed electrically conductive windings towards each other;

providing at least one coil of strip-shaped ferromagnetic material;

fixing an initial free edge of the strip-shaped ferromagnetic material to the electrically conductive windings;

moving said at least one coil of strip-shaped ferromagnetic material along a closed path linking the two electrically conductive windings, forming a ferromagnetic core linked to said two electrically conductive windings.

Practically, each electrically conductive winding may include one or more conductors wound to form a respective coil of a primary circuit and/or a secondary circuit of the transformer. The electrically conductive windings may be made in any suitable manner, using for example a lamination conductor, or a linear one. The electrically conductive windings may be formed in a separate process, not relevant to the purposes of the present description.

Generally speaking, the method described herein may be used to produce any transformers. The method has great advantages for the production of three-phase transformers, typically comprised of three electrically conductive windings linked to a plurality of ferromagnetic cores, typically three ferromagnetic cores.

Each electrically conductive winding may comprise the primary circuit and the secondary circuit of the respective phase.

With the ferromagnetic core manufacturing method described herein the manufacturing steps can be maintained separate from one another, namely the step of manufacturing the electrically conductive windings can be maintained separate from the step of manufacturing the ferromagnetic core(s). It is therefore possible to choose the most suitable technique and materials for the production of the electrically conductive windings, for example copper or aluminum strips, that could not be wound around a previously formed ferromagnetic core, as occurs in the known techniques of amorphous material transformer manufacturing.

As the space available along the path linked to the windings is limited, it may be necessary to provide not just one coil, but a plurality of coils of strip-shaped ferromagnetic material. In this case, the method comprises the steps of: fastening the initial free edges of the strip-shaped ferromagnetic material of each coil to the electrically conductive windings; moving the coils of strip-shaped ferromagnetic material along the closed path linking the electrically conductive windings, thus forming the ferromagnetic core linked to the two electrically conductive windings by winding a plurality of strips of ferromagnetic material.

If the formation of the ferromagnetic core requires an amount of ferromagnetic material which is greater than the amount that can be collected in strip-form in the coils arranged along the linked path, the steps described above may be repeated. Every time the coils of strip-shaped ferromagnetic material are exhausted, they can be replaced with new coils, whose initial edges are fixed on the outer surface of the core that has been partially formed during the previous step. The new coils move along the closed path, so as to unwind the respective strips and increase the volume of the ferromagnetic core.

Advantageously, the strip-shaped ferromagnetic material is an amorphous metal, for example a boron-containing iron alloy. The strip-shaped ferromagnetic material may be very thin, with thickness in the order of 0.02 mm. With the method described herein it is possible to have a ferromagnetic core of suitable volume by arranging an adequate amount of coils along the closed path and, if necessary, by repeating the process several times.

The coils of ferromagnetic material may be mounted on unwinding pins or spindles, connected, for example, to a continuous flexible member moving along the path linked to the electrically conductive windings. To have a sufficiently compact ferromagnetic core, the strip-shaped ferromagnetic material shall be suitably tensioned, for example by means of braked pins, unwinding the strip-shaped ferromagnetic material by friction.

In practical embodiments, the transformer has more than two electrically conductive windings, for example three electrically conductive windings for three phases of a three-phase system. In this case, the ferromagnetic circuit may comprise three ferromagnetic cores, each of which is formed as described above and as detailed below with reference to some embodiments. In particular, it is possible to form: a first ferromagnetic core linked to a first electrically conductive winding and to a second electrically conductive winding, a second core linked to the second electrically conductive winding and to the third electrically conductive winding, and a third core linked to the first electrically conductive winding and to the third electrically conductive winding. Combined together, the three ferromagnetic cores form a composite ferromagnetic core with three columns, around which the three electrically conductive windings are wound.

According to a further aspect, a device is provided for the production of a transformer comprised of at least two electrically conductive windings adjacent to one another, and of a ferromagnetic core linked to the two electrically conductive windings and formed by winding strip-shaped ferromagnetic material; said device comprising guide members configured and arranged so as to define a closed path linked to said two electrically conductive windings, along which one or more coils of strip-shaped ferromagnetic material move, so as to unwind the strip-shaped ferromagnetic material from said coil(s) and to form the ferromagnetic core linked to the two electrically conductive windings.

The guide members may comprise a linear guide and a conveyor moving along the linear guide.

According to a further aspect, a transformer is disclosed, comprised of at least two electrically conductive windings adjacent to one another, each of which is formed by conductors that are wound so as to form respective coils, and of a first ferromagnetic core formed by a plurality of strips of ferromagnetic material, each strip of ferromagnetic material having an initial edge and a final edge, each strip of ferromagnetic material forming a plurality of continuous turns, and the turns of the single strips of ferromagnetic material being interposed between one another.

Further features and embodiments of the method, of the device, and of the transformer according to the present invention are described hereunder with reference to examples of embodiment and in the appended claims, which form an integral part of the present description.

BRIEF DESCRIPTION OF THE DRAWINGS

The invention will be better understood by following the description and the accompanying drawing, which shows non-limiting practical embodiments of the invention. More in particular, in the drawing:

FIG. 12A schematically shows a cross-section of a complete three-phase transformer according to a plane orthogonal to the winding axis of the ferromagnetic cores;

FIG. 12B shows an enlargement of a detail of FIG. 12A;

DETAILED DESCRIPTION OF EMBODIMENTS

The detailed description below of example embodiments is made with reference to the attached drawings. The same reference numbers in different drawings identify the equal or similar elements. Furthermore, the drawings are not necessarily to scale. The detailed description below does not limit the invention. The protective scope of the present invention is defined by the attached claims.

In the description, the reference to "an embodiment" or "the embodiment" or "some embodiments" means that a particular feature, structure or element described with reference to an embodiment is comprised in at least one embodiment of the described object. The sentences "in an embodiment" or "in the embodiment" or "in some embodiments" in the description do not therefore necessarily refer to the same embodiment or embodiments. The particular features, structures or elements can be furthermore combined in any suitable way in one or more embodiments.

FIGS. 1-5 illustrate the main parts of an embodiment of a device according to the invention. In FIG. 1-5 the device is shown without the support for the electrically conductive windings, which is shown in following FIGS. 6, 7, and 8. In the figures, the electrically conductive windings are only schematically shown, and are indicated with A, B and C.

The illustrated example shows the process for winding the ferromagnetic cores of a three-phase transformer. The same method may be also used for manufacturing ferromagnetic cores for single-phase transformers.

In practice, each electrically conductive winding A, B, C contains at least one coil of a primary winding and at least one coil of a secondary winding.

Figure 6:
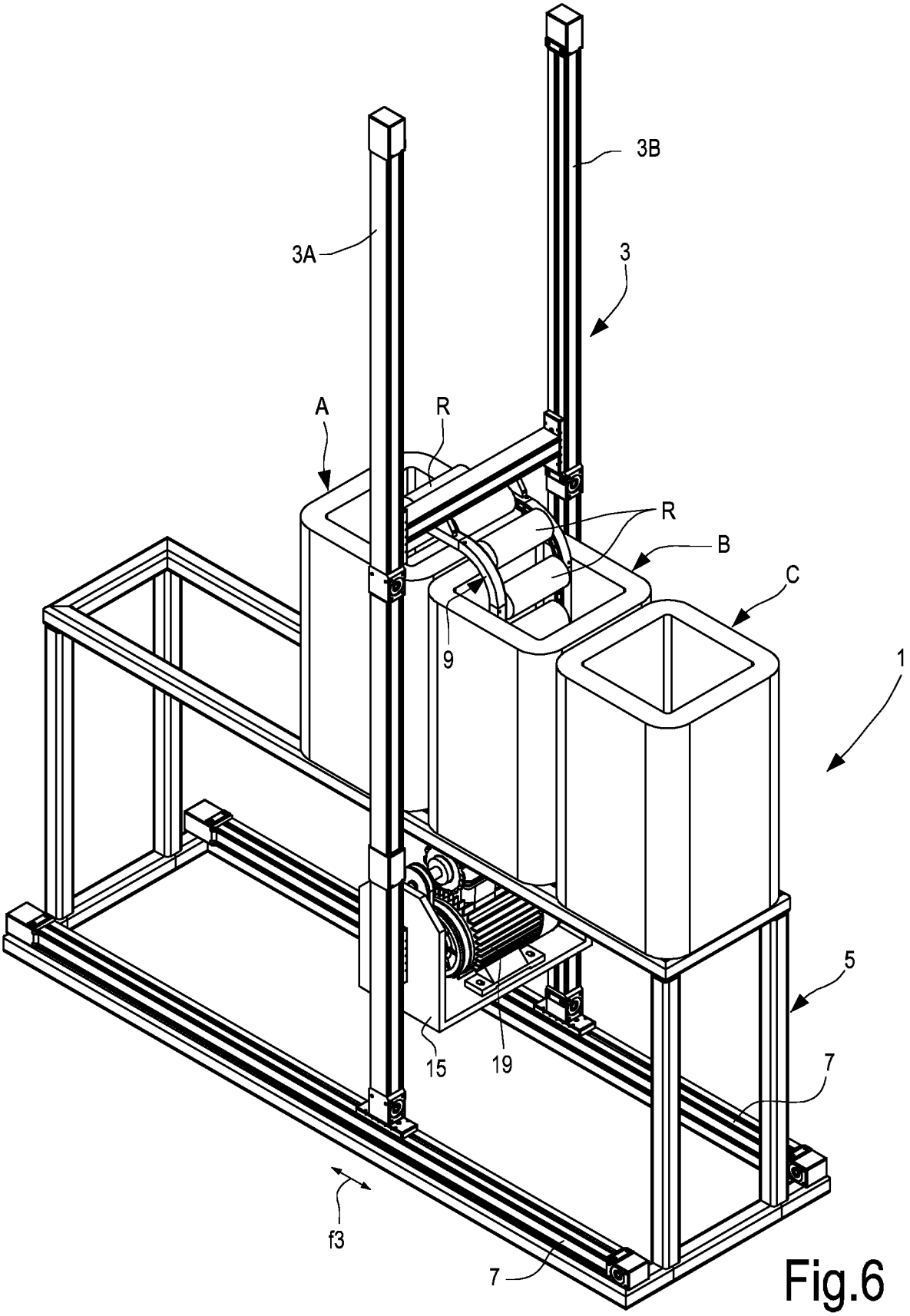
FIGS. 6, 7 and 8 show steps of a method for the formation of ferromagnetic cores in a three-phase transformer.
Figure 7:
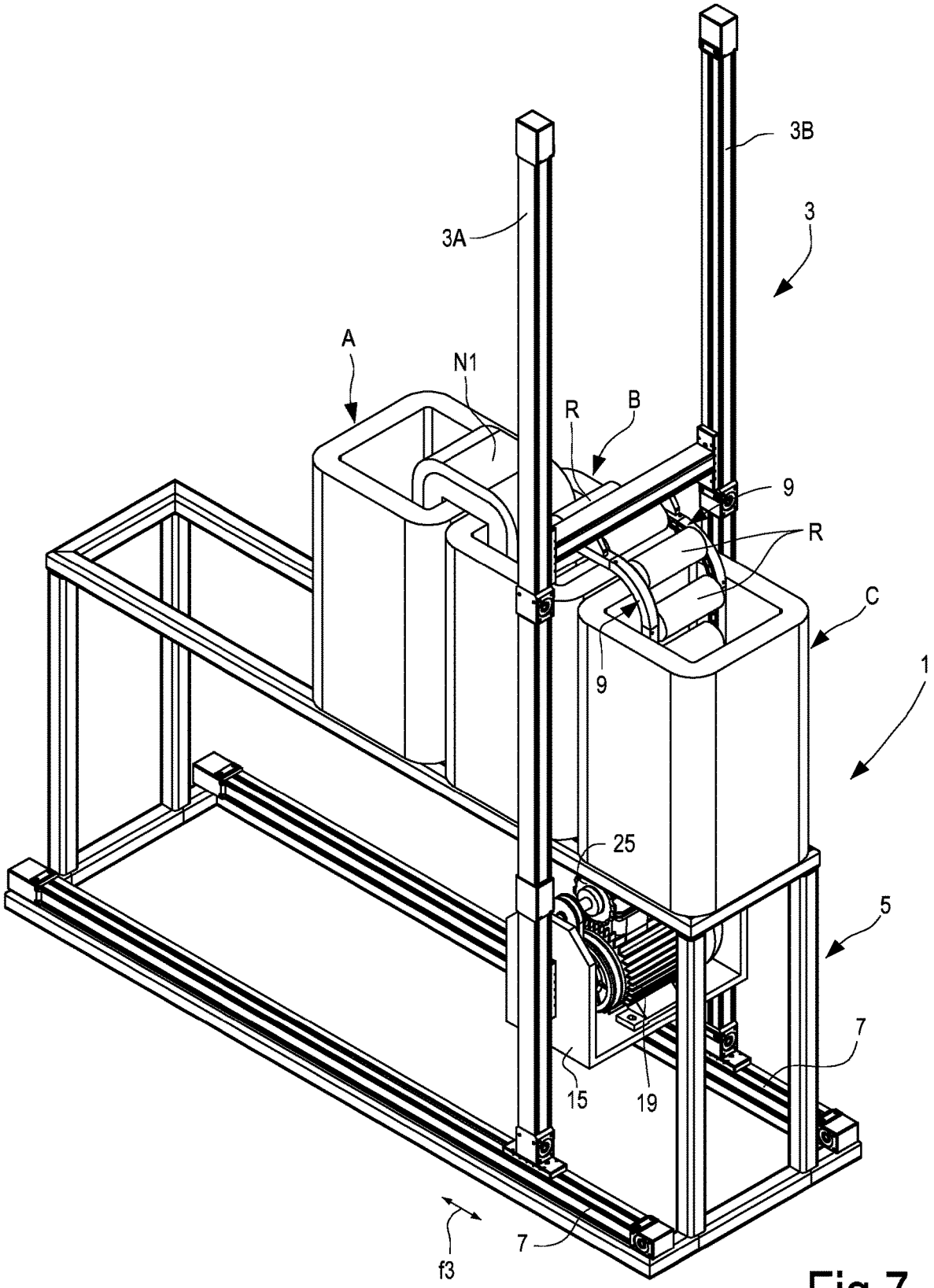
Figure 8:
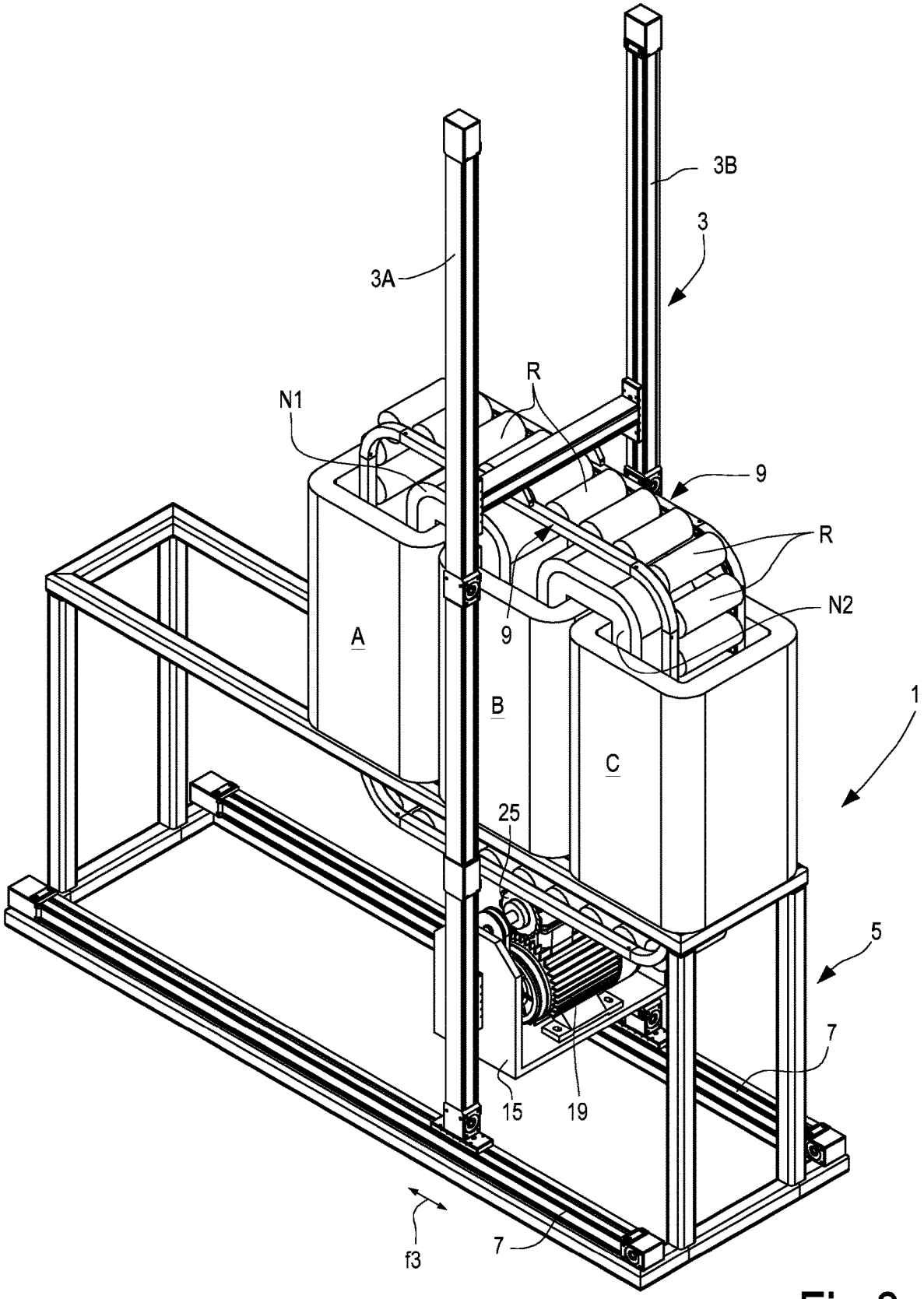

The device is labeled 1 as a whole, and is comprised of a support frame 3 supporting winding members, described below, for winding a strip-shaped ferromagnetic material, thus forming one or more ferromagnetic cores of the transformer. As shown in FIGS. 6, 7 and 8, the support frame 3 is associated with a support 5, onto which the electrically conductive windings A, B, C of a transformer are arranged, that are schematically illustrated in FIG. 6-8.

In some embodiments, guides 7 extend along the support 5, allowing the motion of the support frame 3 according to the double arrow f3. In this way, as shown in FIGS. 6, 7 and 8 and as will be detailed below, the support frame 3 may take different positions along the support 5 to form the various ferromagnetic cores around portions of electrically conductive windings A, B, C.

Figure 1:
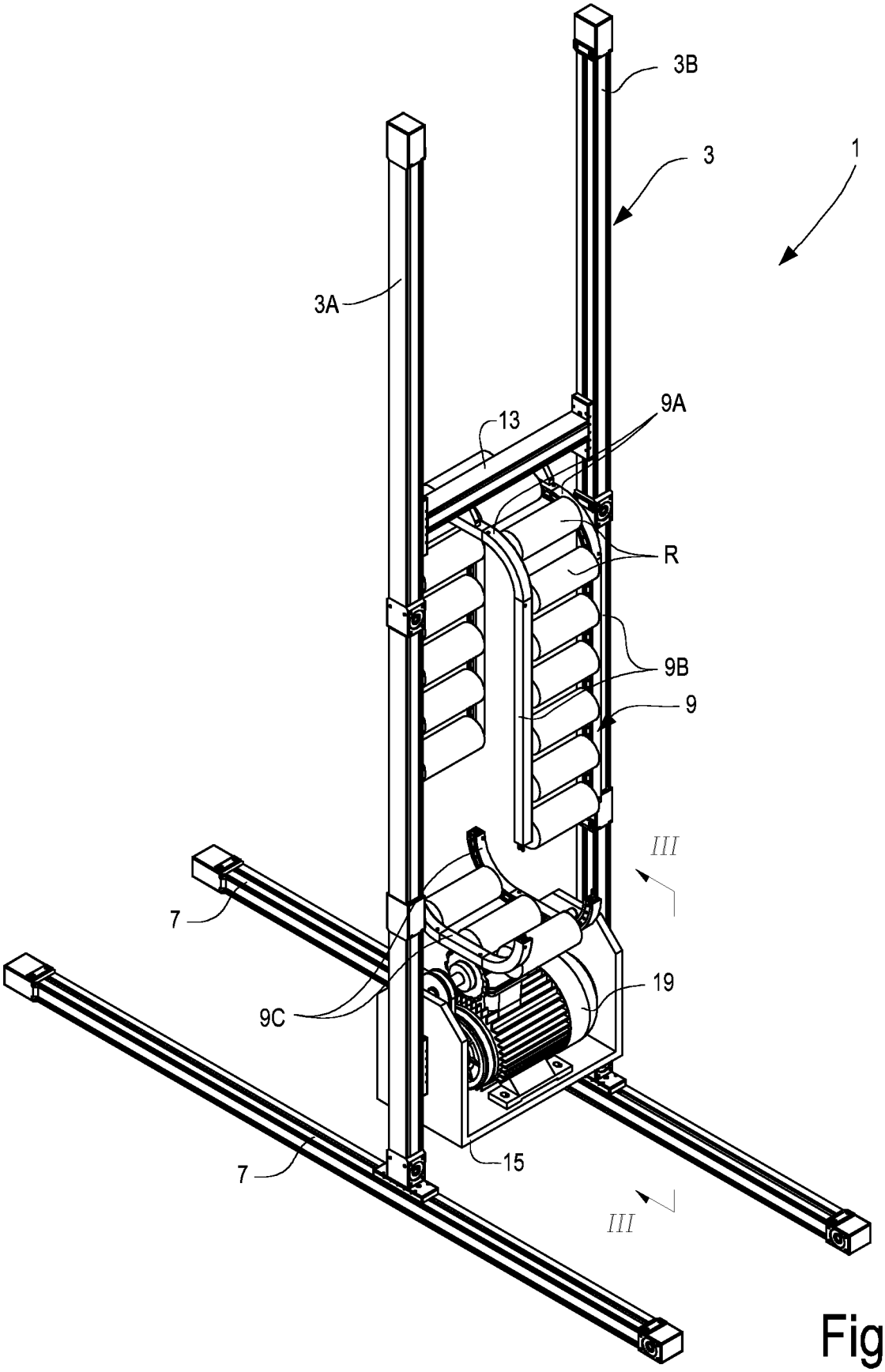
FIG. 1 is an axonometric view of a device for the production of a core according to the invention.
Figure 2:
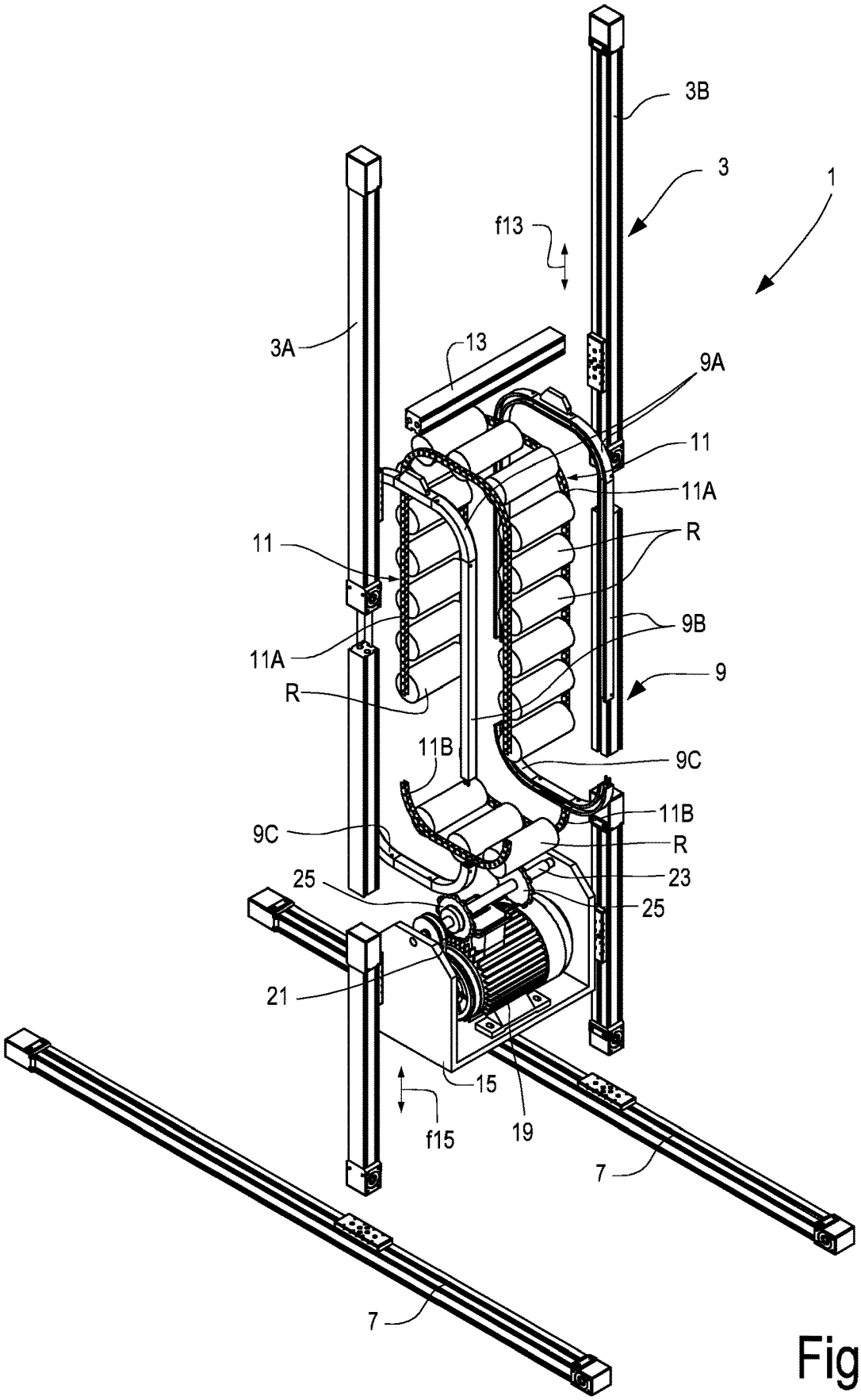
FIG. 2 is an exploded view of the device of FIG. 1.
Figure 3:
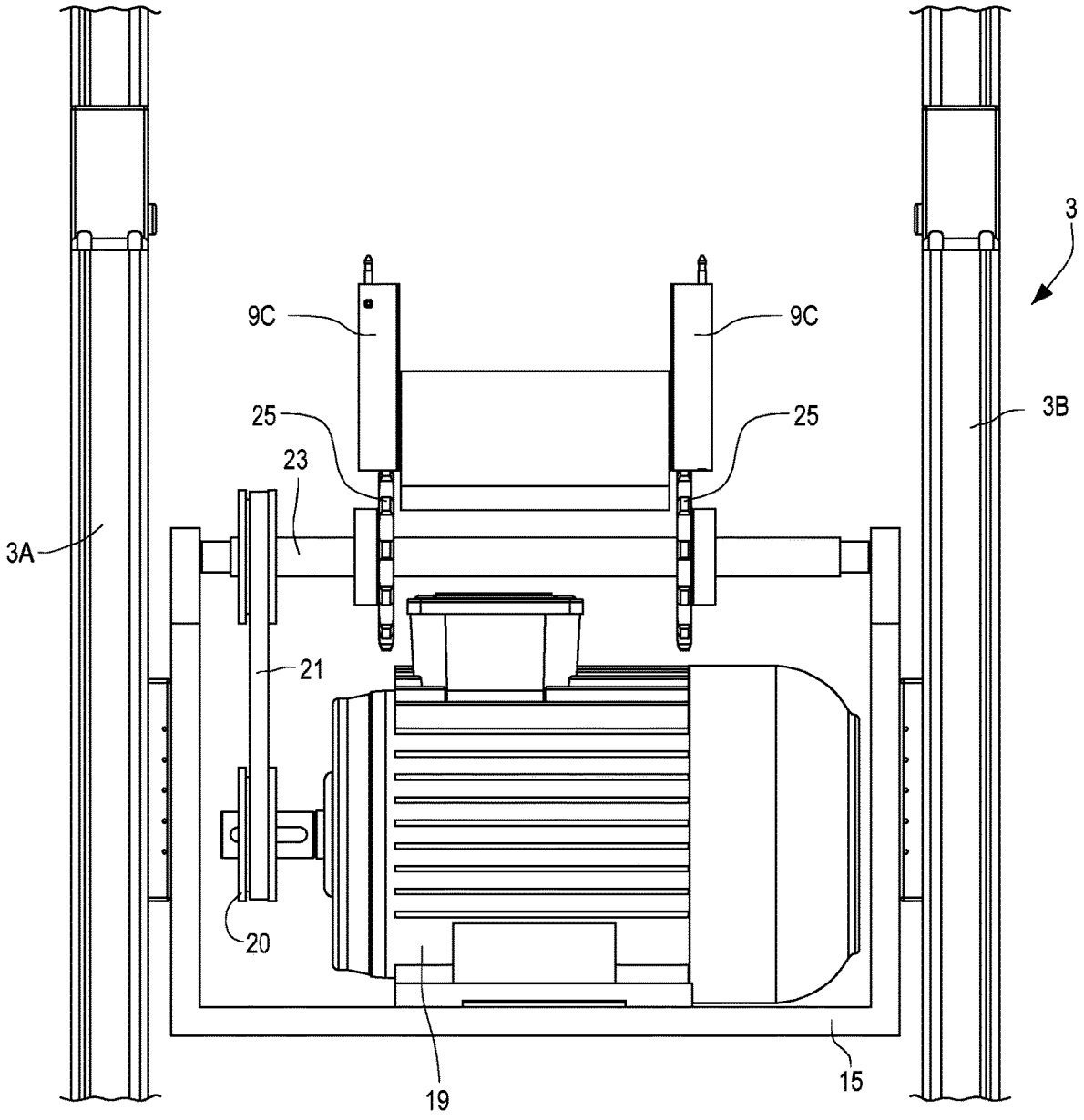
FIG. 3 is a side view according to III-III in FIG. 1.

As is shown specifically in FIGS. 1-3, the support frame 3 supports a linear guide 9. In the illustrated embodiment, the linear guide 9 is a double guide, comprised of two opposite guide channels for two respective flexible members moving along a closed path, as detailed below. It is also possible to use a single linear guide.

The linear guide is advantageously subdivided into at least two parts. In this way it can be assembled so as to link one or more electrically conductive windings.

In particularly advantageous embodiments, the linear guide is subdivided into a plurality of portions indicated with 9A, 9B, 9C. Each portion, or some portions, may be further subdivided into sub-parts. As it will be clearly apparent below, the fact that the linear guide is subdivided into portions that can be assembled allows to adapt the linear guide to the dimensions of the ferromagnetic cores that shall be wound, so that it is possible to manufacture transformers of different dimensions and/or to wind ferromagnetic cores of different dimensions in a same transformer.

The support frame 3 comprises two uprights 3A, 3B supporting the double linear guide 9.

As shown in particular in the exploded view of FIG. 2, the linear guide comprises two symmetrical channels, inside which flexible members, for instance chains, are inserted. A chain 11 is inserted in each channel forming the double linear guide 9. Once mounted, the chain defines a continuous flexible member. In the exploded view of FIG. 2, each chain 11 in subdivided into two portions 11A and 11B. The two portions 11A, 11B of each chain 11 are joined together, for example by means of connecting links, i.e. links that can be opened by removing an articulation pin.

In other embodiments, the chain or other flexible member 11 can be opened at only one point, instead of being subdivided into two portions that can be separated from each other.

As will be clearly apparent from the description of the ferromagnetic core production process, the double linear guide 9, 9A, 9B, 9C with the corresponding flexible members 11, 11A, 11B is arranged around two electrically conductive windings adjacent to each other, so as to form a path linked to the windings. Coils of strip-shaped ferromagnetic material move along this path, so as to form turns that are arranged over one another and that form, once they will be consolidated together, the proper ferromagnetic core. To this end, coils R of strip-shaped ferromagnetic material are fastened to the chains 11, 11A, 11B. The number of coils R of strip-shaped ferromagnetic material varies according to the thickness and the length the ferromagnetic core must have. In some embodiments, not shown, two or more coils of strip-shaped ferromagnetic material are arranged coaxial with one another. In this way, it is possible to form a core having a thickness which is greater than the width of the strip-shaped ferromagnetic material forming a single coil R.

In some embodiments, the linear guide 9 is supported by the support frame 3 through un upper support 13 and a lower support 15. The two supports, the upper one 13 and the lower one 15, can be adjusted according to the double arrow f13 and to the double arrow f15, respectively, along the vertical extension of the support frame 3 and, more exactly, along the uprights 3A, 3B of said support frame 3.

In some embodiments, an actuator, for example an electric motor 19, is associated with the lower support 15. The motor can transfer the movement from a drive pulley 20 to a driven shaft 23, for example by means of a belt 21 (see in particular FIG. 3). Pinions or chain wheels 25 are keyed on the shaft 23. Each pinion or chain wheel 25 meshes with the corresponding continuous flexible member 11, 11A, 11B, for example through a window provided in the linear guide 9, 9A, 9B, 9C. In this way, the motor 19 controls the sliding motion of the flexible member 11 along the linear guide 9, and moves therefore the coils R of strip-shaped ferromagnetic material along the closed path defined by the linear guide 9, 9A, 9B, 9C and by the flexible members 11, 11A, 11B and linking the electrically conductive windings A, B, C.

In some embodiments, the chain 21, the drive pulley 20, the shaft 23 and the pinions or chain wheels 25 are replaced with a toothed chain or similar transmission system. Said chain is moved by the motor 19 through an adequate gear (pinion) and directly moves the continuous flexible member 11, 11A, 11B. In this embodiment, the toothed chain is mounted on at least three pinions arranged in a triangle, one of which is actuated by the motor 19. In this embodiment the motion transmission between toothed chain and continuous flexible member 11, 11A, 11B occurs, for instance, through a window provided in the linear guide 9, 9A, 9B, 9C.

Figure 5:
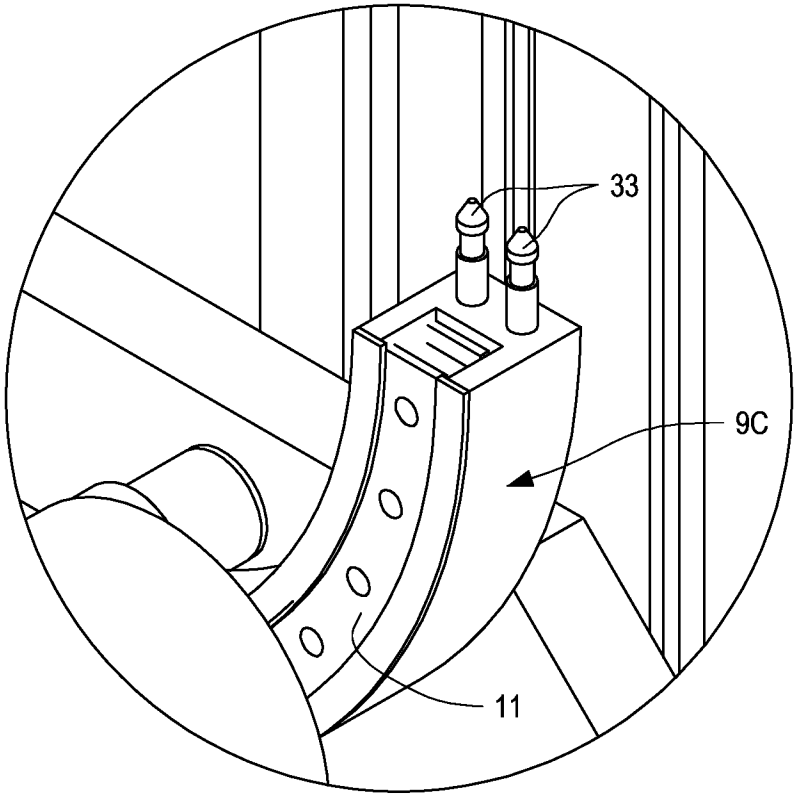
FIGS. 4 and 5 show enlarged details of the joining areas between portions of the linear guide of the device of FIG. 1-3.
Figure 4:
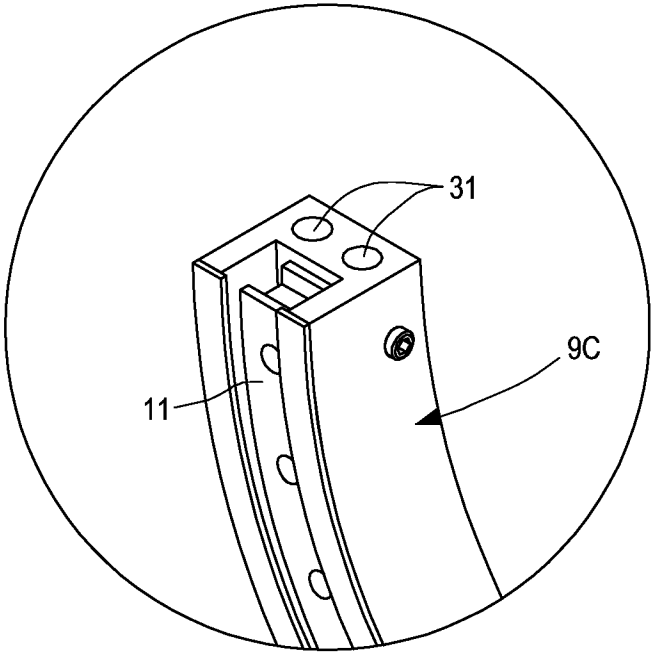

FIGS. 4 and 5 schematically show the ends of a channel portion forming the linear guide 9, 9A, 9B, 9C. Just by way of example FIGS. 4 and 5 show the two opposite ends of one of the channels forming the lower portion 9C of the linear guide 9. Numbers 31 and 33 schematically indicate male-female couplings for joining the channels forming the portions of linear guide 9C and 9B. In FIGS. 4 and 5 the continuous flexible member 11, for instance the chain, is also schematically illustrated, sliding inside the channels defining the linear guide 9. The male-female couplings 31, 33 are a simplified embodiment of the coupling means for joining together the channel portions forming the linear guide 9. Other embodiments are also possible, for example side joints, outer clamps engaging appendices of the channel portions, or the like.

For a better understanding of the operation of the device described above, FIGS. 6, 7 and 8 illustrate three subsequent steps for the formation of ferromagnetic cores defining the magnetic circuit of a three-phase transformer comprising electrically conductive windings A, B, C.

In practical embodiments, each winding A, B, C is constituted by a double high/medium voltage winding or medium/low voltage winding, respectively. The electrically conductive windings are embedded in a polymerized resin providing mechanical stability to the electrically conductive windings. The structure of the electrically conductive windings A, B, C is not important for the purposes of the description of the present invention. What is important is only that the electrically conductive windings A, B, C are adjacent to each other and that ferromagnetic cores linked to said electrically conductive windings are formed through the device 1.

FIG. 6 shows the first step for the formation of a first ferromagnetic core N1 (see FIG. 7) linked to the electrically conductive windings A and B.

To form the ferromagnetic core N1, the linear guide 9 has been assembled so as to define a closed path linked to the two adjacent windings A, B. Coils R of strip-shaped ferromagnetic material, typically an amorphous metal, are arranged along the linear guide 9. By fastening the leading ends or the final ends of each strip of ferromagnetic material of the coils R to the electrically conductive windings A, B, and moving each coil R along the closed path linked to the electrically conductive windings A, B, the strip-shaped ferromagnetic material of each coil R is unwound and forms a series of turns along the closed path linked to the electrically conductive windings A, B, until the final ferromagnetic core, schematically shown in FIG. 7, is formed, linked to the electrically conductive windings A, B.

The linear guide 9 is assembled by combining linear guide portions 9A, 9B, 9C together by means of the couplings shown just by way of example in FIGS. 4, 5. The guide portions are interchangeable, so that it is possible to form a ferromagnetic core N1 of dimensions suitable to the dimension of the transformer that shall be manufactured. To this end, the intermediate portions 9B can be longer or shorter depending upon the height of the electrically conductive windings A, B. Moreover, the upper portions 9A and the lower portions 9C can have different shapes and lengths according to the thickness of the windings A, B.

In some embodiments, the linear guide 9 can be subdivided into rectilinear portions and curved portions. The curved portions, practically constituted by eight curved segments of the channels forming the linear guide, are joined together by means of eight rectilinear segments of said channels, having suitable lengths, depending upon the dimension of the ferromagnetic core N1 to be manufactured. The device 1 is provided with eight curved portions of guide channel and with a plurality of sets of rectilinear portions of different lengths, that can be interchanged and assembled according to the production needs.

FIG. 7 shows a following step of the transformer production process, wherein the first ferromagnetic core N1 has been already formed and the linear guide 9, supported by the support frame 3, has been arranged along a second closed path linked to the adjacent electrically conductive windings B and C, so as to form a second ferromagnetic core N2. The operation required for manufacturing the second ferromagnetic core N2 is repeated in the arrangement of FIG. 7, with a process substantially equal to that used for the ferromagnetic core N1. The complete ferromagnetic core N2 is shown in FIG. 8.

Figure 9:
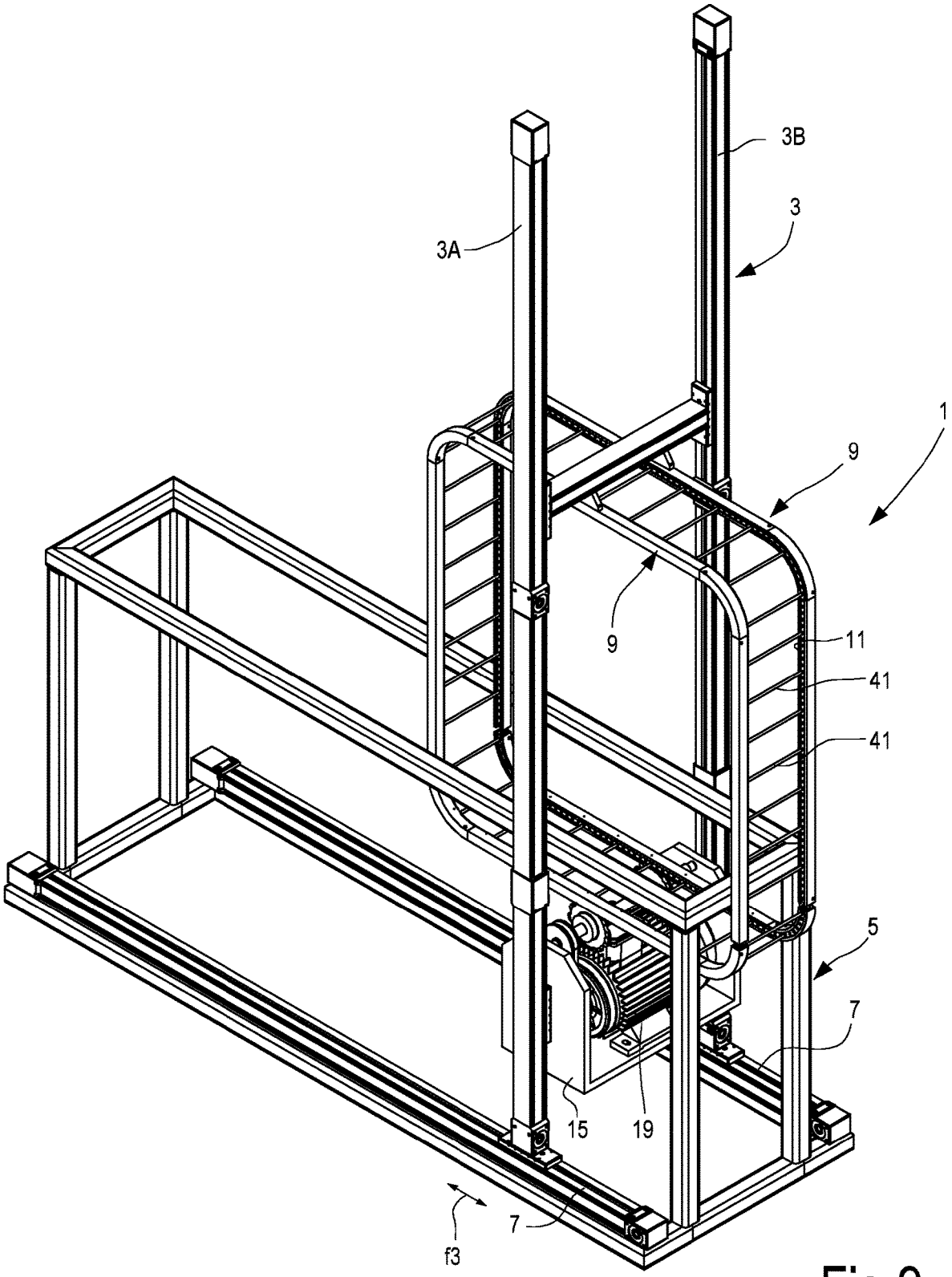
FIG. 9 is an exploded view of the device set-up for the formation of the larger core of the transformer shown in the sequence of FIGS. 6, 7 and 8.

FIG. 8 also shows a further arrangement of the linear guide 9, that in this case has a greater dimension both in the horizontal and in the vertical segment, so as to form a third ferromagnetic core N3 linked to the electrically conductive windings A and C. FIG. 9 is an exploded view of the components of the device in the arrangement for the formation of the third ferromagnetic core N3. In addition to the double linear guide 9, the support frame 3 and the motor for moving the flexible members 11, in this figure also pins 41 are shown, supporting coils R of strip-shaped ferromagnetic material. The coils R are supported idle so that they can be unwound by traction when the leading end of the strip-shaped ferromagnetic material has been fastened to one of the electrically conductive windings and the axis of the coil R moves along the closed path defined by the linear guide 9. The pins 41 are braked so as to tension the strip-shaped ferromagnetic material during unwinding. This ensures that compact turns form.

Figure 10A:
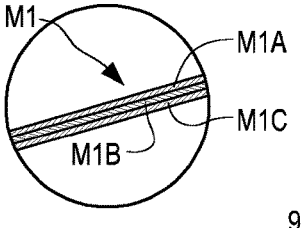
FIG. 10A shows an enlargement of the detail XA of FIG. 10.
Figure 10:
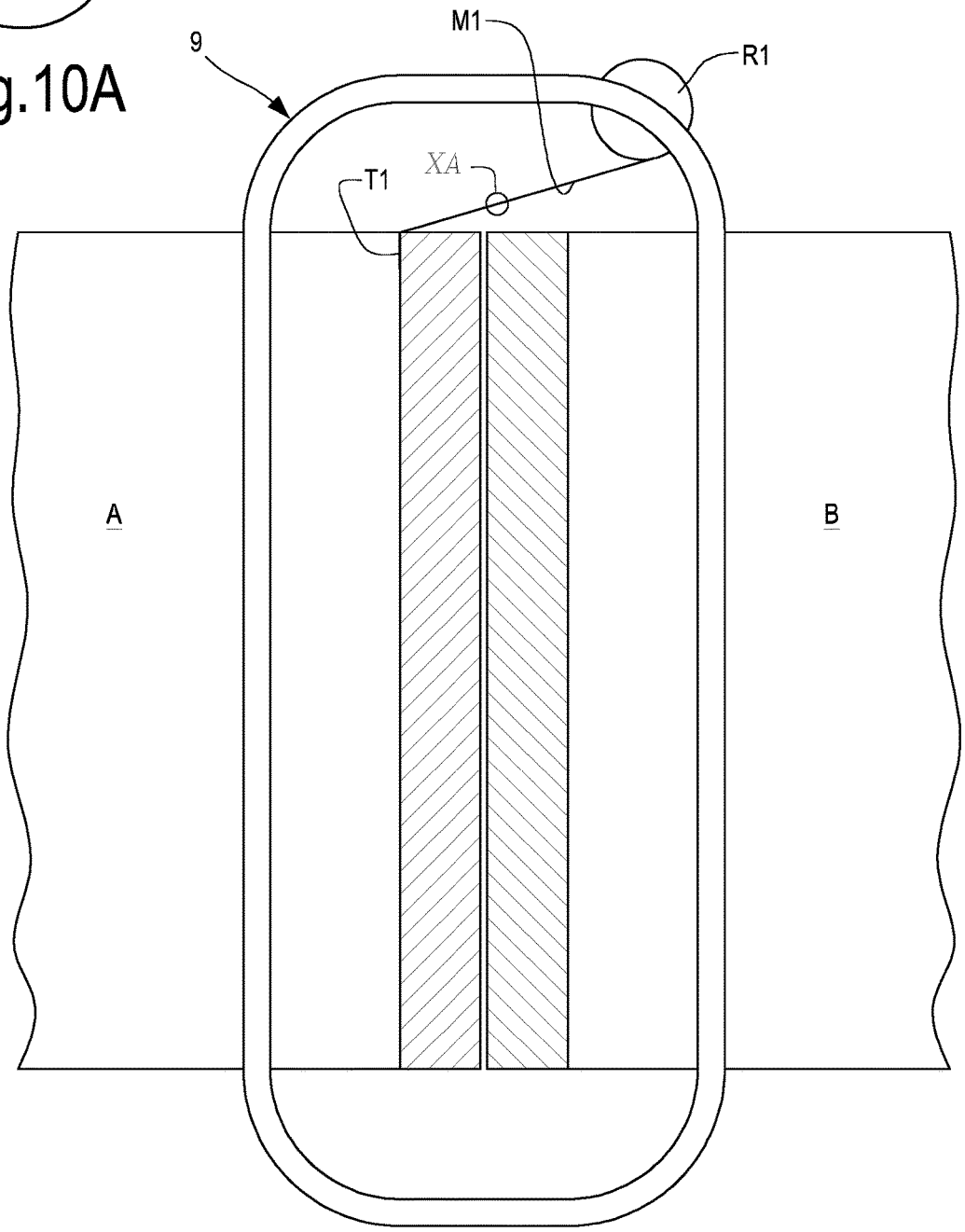
FIGS. 10-12 schematically show the initial steps of the winding of a ferromagnetic core.
Figure 11:
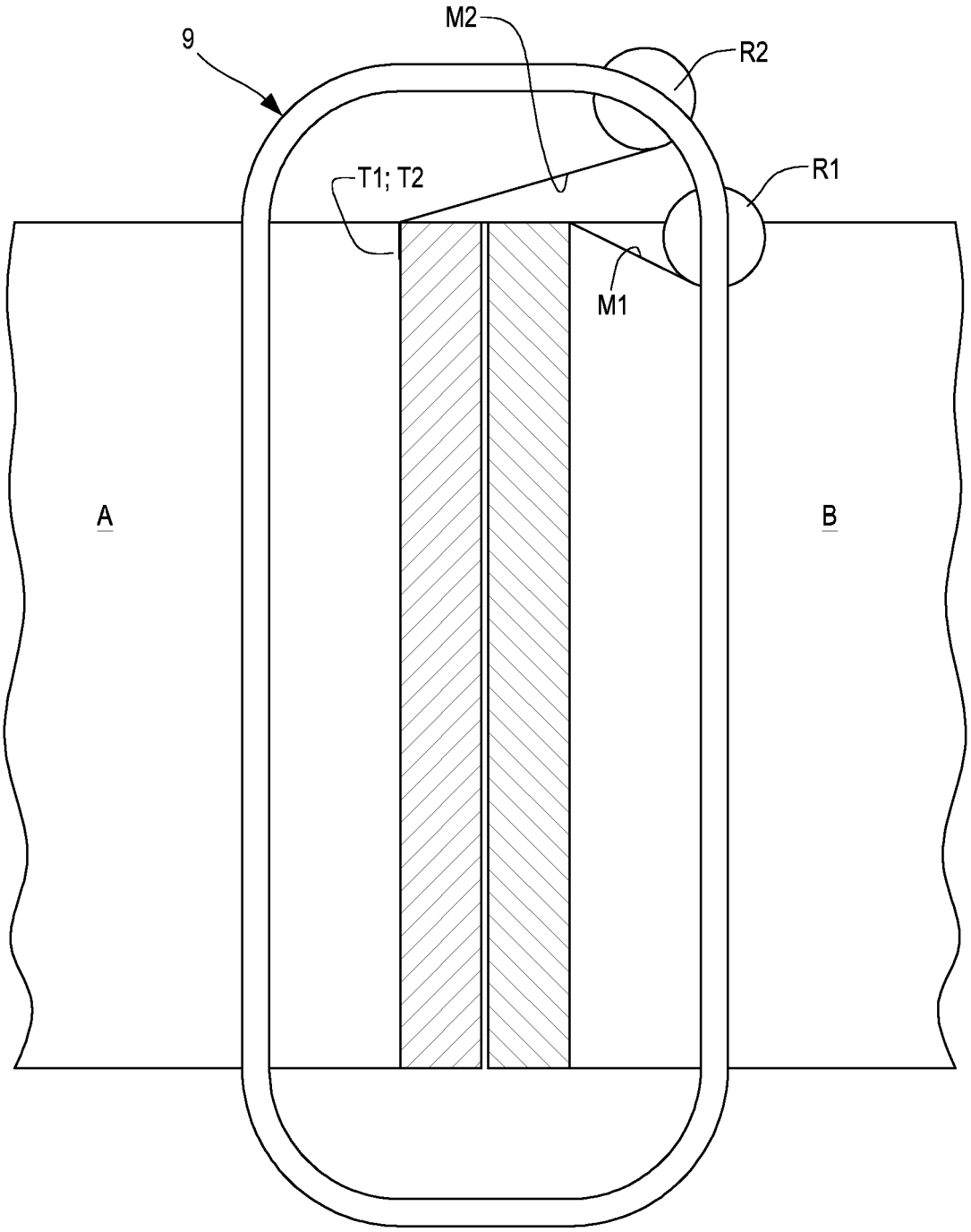
Figure 12:
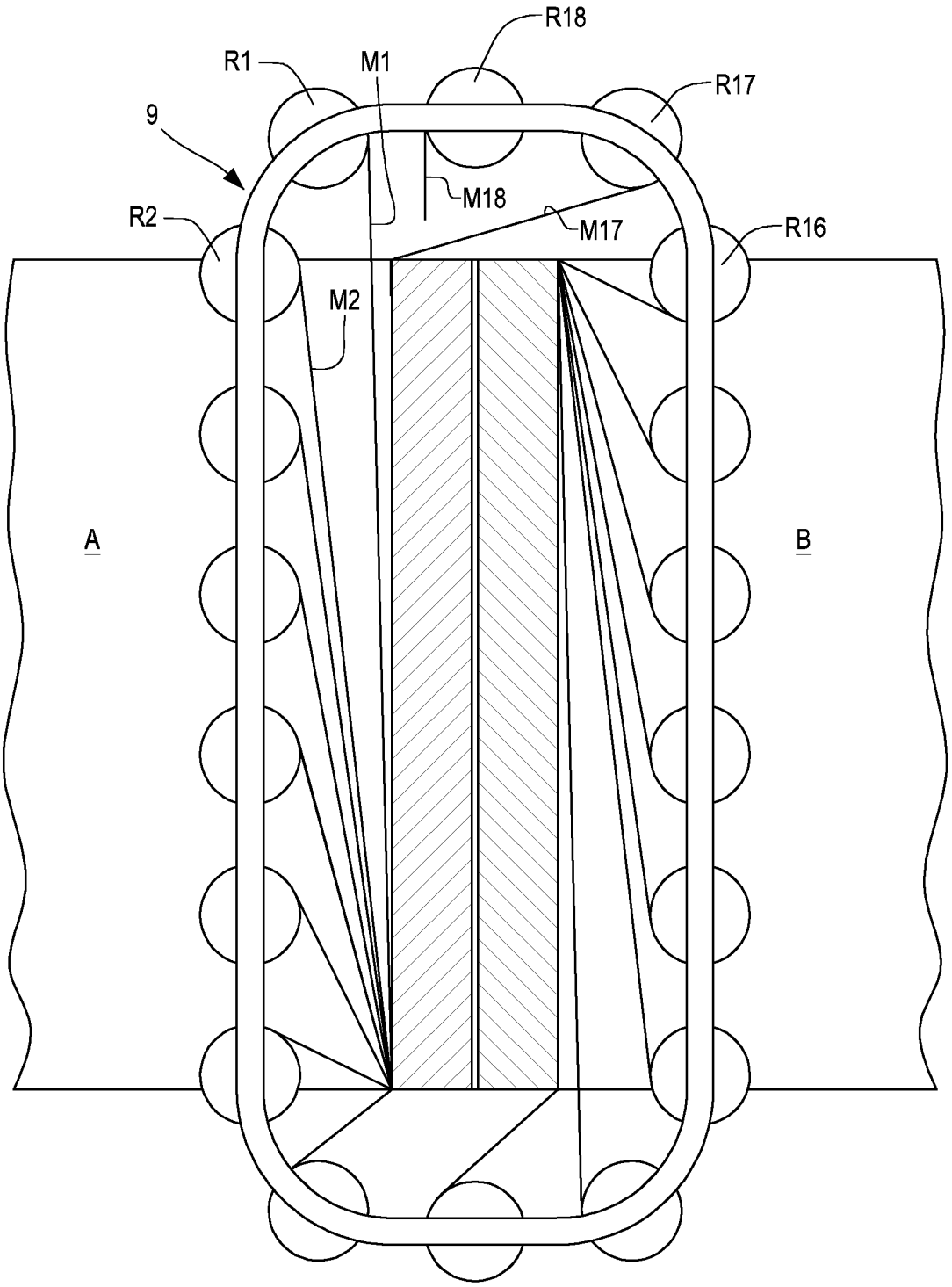

For a better understanding of the beginning of the winding of each ferromagnetic core N1, N2, N3, FIGS. 10, 11 and 12 schematically illustrate the initial step, wherein the leading ends of the strip-shaped ferromagnetic material of each coil R are fastened to the fixed part constituted by the block of the electrically conductive windings A, B or B, C.

FIGS. 10, 11 and 12 show, by way of example, the initial preparation step of the coils R of strip-shaped ferromagnetic material for the formation of the ferromagnetic core N1 linked to the electrically conductive windings A and B. The linear guide is schematically indicated with 9 in FIGS. 10, 11 and 12. In FIG. 10, a first coil R of strip-shaped ferromagnetic material M1 is mounted on the linear guide 9, wherein the leading edge of the material, indicated with T1, directly or indirectly adheres to one or to the other of the electrically conductive windings A, B and more exactly, in the illustrated example, to the electrically conductive winding A. Fastening may be obtained using an adhesive tape, for instance.

The strip-shaped ferromagnetic material M1 may be constituted by only one strip or by a plurality of adjacent layers wound around the same coil R1. In FIG. 10A a schematic enlargement of a portion of strip-shaped ferromagnetic material M1 is shown, wherein the ferromagnetic material in actually formed by a plurality of layers M1A, M1B, M1C. In this case three layers are provided, but the number thereof may be different.

The coil R1 is prepared by unwinding and rewinding a parent reel of large radial dimensions, around which one or more layers of ferromagnetic material are wound. In other embodiments, the coil R1 is formed by rewinding several layers from different parent reels, for instance three or more reels, so as to form a multi-layer coil starting from one-layer parent reels.

Generally speaking, the coils of ferromagnetic materials can be prepared in any way.

The coil R1 of strip-shaped ferromagnetic material M1 is mounted on a respective pin 41, the ends whereof are in turn mounted on the flexible member 11 formed by the two chains housed in the two opposite channels forming the linear guide 9.

Once the end of the strip-shaped ferromagnetic material M1 is fastened to the electrically conductive winding A or B, the flexible member 11 translates by one step around the closed path formed by the linear guide 9, linked to the electrically conductive windings A, B, and takes the position illustrated in FIG. 11.

At this point, a second coil R2 of strip-shaped ferromagnetic material M2 is mounted on the linear guide 9, and also the leading end T2 of the material M2 is caused to adhere to the electrically conductive winding A. The process continues, with the flexible member 11 moving forwards stepwise along the closed path linked to the electrically conductive windings A, B, until all the available positions (pins 41) are taken by coils R of strip-shaped ferromagnetic material, as shown in FIG. 12. In the schematic illustrated in the figure by way of example, eighteen coils R1-R18 are provided. Each coil contains a given amount of strip-shaped ferromagnetic material M1-M18. The leading edge of each strip of ferromagnetic material M1-M18 is fastened to the fixed part formed by any one or the other of the electrically conductive windings A, B, to which the path defined by the linear guide 9 is linked.

The actual winding of the ferromagnetic core begins from the condition of FIG. 12. To this end, the flexible member 11 moves along the linear guide 9 following the path linked to the electrically conductive windings A, B, gradually unwinding all coils R1-R18 of strip-shaped ferromagnetic material M1-M18. In this way, each strip of ferromagnetic material forms a series of turns, i.e. a coil around the portion of the electrically conductive windings A, B, whereto the path defined by the linear guide 9 is linked.

The turns of the strips of ferromagnetic materials M1-M8 are interposed between one another. Essentially, a multiple turn, constituted by eighteen strips wound in parallel, forms around the two portions of electrically conductive windings A, B, to which the ferromagnetic core N1 being formed is linked.

As the diameter dimension of the coils R is limited by the space available along the path defined by the linear guide 9, if the amount of strip-shaped ferromagnetic material of the eighteen coils R1-R18 is not enough to form a ferromagnetic core of sufficient thickness, once the coils R1-R18 have been completely unwound, it is possible to repeat the process by mounting a new series of eighteen coils and fastening the leading edges of the strips of ferromagnetic material to the outside of the last turn formed during the winding of the strips M1-M18. If necessary, before mounting the new series of eighteen coils, it is possible to remove the linear guide 9 and to assembly it again using longer rectilinear portions, thus defining a longer closed path, i.e. having dimensions suitable to receive the ferromagnetic core, whose size increases as the strips of ferromagnetic material are wound.

It should be understood that the number of coils, here eighteen coils, is just by way of non-limiting example.

If the width of the ferromagnetic core to be produced is greater than the axial length of the coils R, two or more coaxial coils can be mounted on each pin 41.

In the scheme illustrated in the attached figures, the coils R1-R18 unwind rotating clockwise. However, this is not mandatory; the coils can be also arranged in reverse, so as to unwind rotating counterclockwise.

The process described herein is repeated for the winding of each ferromagnetic core N1, N2, N3.

FIG. 12A schematically shows a cross section, according to a vertical plane, of the transformer once the ferromagnetic cores N1, N2, N3, linked to the electrically conductive windings A, B, C, have been completely wound. In this figure it is clearly apparent that the three windings forming the ferromagnetic cores N1, N2, N3 form, as a whole, a single overall ferromagnetic core, having a shape similar to that of a traditional three-phase transformer with two yokes and three columns, around which the electrically conductive windings A, B, C are arranged. Each column is formed by a pair of vertical (in the figure) portions of the coils or turns forming the ferromagnetic cores N1, N2, N3. Each yoke is formed by a horizontal portion of the core N3 and by the horizontal upper or lower portions of the cores N1 and N2.

Each core N1, N2 is formed and directly supported on the electrically conductive windings A, B and B, C, without the need for interposing a winding reel, as in methods according to the current art. This results in a significantly more compact overall structure, and therefore in high savings in terms of ferromagnetic material, and thus in a more compact, more economical and more efficient final product.

FIG. 12B shows an enlarged detail of the ferromagnetic core of FIG. 12A. The enlarged detail shows a portion of the outer ferromagnetic core N3, formed by turns of the various ferromagnetic strips M1 put over one another. The schematic view of FIG. 12B shows portions of turns formed in sequence from strips of ferromagnetic material M18, M17, M16 . . . M10. From what illustrated and from the description above it is clearly apparent that the turns of strips of ferromagnetic material formed by the coils R1-R18 are arranged over one another and interposed between one another. For example: around the turn formed by the ferromagnetic strip M10 the turn is arranged formed by the ferromagnetic strip M11 and around it the turn is arranged formed by the ferromagnetic strip M12, and so on. This arrangement depends upon the fact that the strips of ferromagnetic material unwind from the coils R1-R18 as the coils move, simultaneously and one after the other, along the path linked to the electrically conductive windings.

In some embodiments, each strip of ferromagnetic material M1-M18 is provided, on at least one of its faces, with a hardening substance, suitable to stabilize the ferromagnetic core formed with the strip-shaped ferromagnetic material, making the turns—formed by said material—adhere to one another. In some embodiments, the hardening substance may comprise a polymerizable resin. The hardening substance may be applied, in liquid or pasty state, on a face or on both faces of the strip-shaped ferromagnetic material of some or of all coils R1-R18. The hardening substance may be applied for example by means of a pad, by spraying, by means of a doctor blade, or in any other manner. In some embodiments, the hardening substance is applied, for example, during a preliminary step of winding of the strip-shaped ferromagnetic material to form each coil R1-R18.

If the coil R1-R18 is formed by more layers wound together, each of them, or some of them, can be provided with a layer of hardening substance.

The hardening substance is preferably electrically insulating and applied so that each turn of strip-shaped ferromagnetic material is electrically insulated from the adjacent turns. This allows reducing the losses due to parasitic currents in the magnetic circuit formed by the ferromagnetic cores N1, N2, N3 and ensures optimal adhesion between all turns of each ferromagnetic core, so as to form a very stable structure.

In other embodiments of the cores N1, N2 and N3, the coils of strip-shaped ferromagnetic material are not provided with hardening substance, which can be advantageously applied directly to the formed cores N1, N2, and N3 by means of a pad, by spraying, by means of a doctor or in any other manner.

In further embodiments, the hardening substance is applied both on the surface(s) of each strip M1-M18 of ferromagnetic material and on the outside of each core N1, N2, N3 forming the overall core of the transformer.

Once the three ferromagnetic cores N1, N2, N3 linked to the electrically conductive windings A, B, C, have been completely wound, as shown in FIG. 12A, the transformer is subjected to a hardening step for hardening the hardening substance applied on the surfaces of the strips M1-M18 of ferromagnetic material. For example, if the substance is a heat-polymerizable resin, the transformer can be put in an oven to polymerize the resin and therefore to consolidate the turns of the strip-shaped ferromagnetic materials M1-M18 together. It is also possible to use substances that harden, for example, through polymerization, at ambient temperature and/or by supplying energy other than thermal energy.

Figure 13:
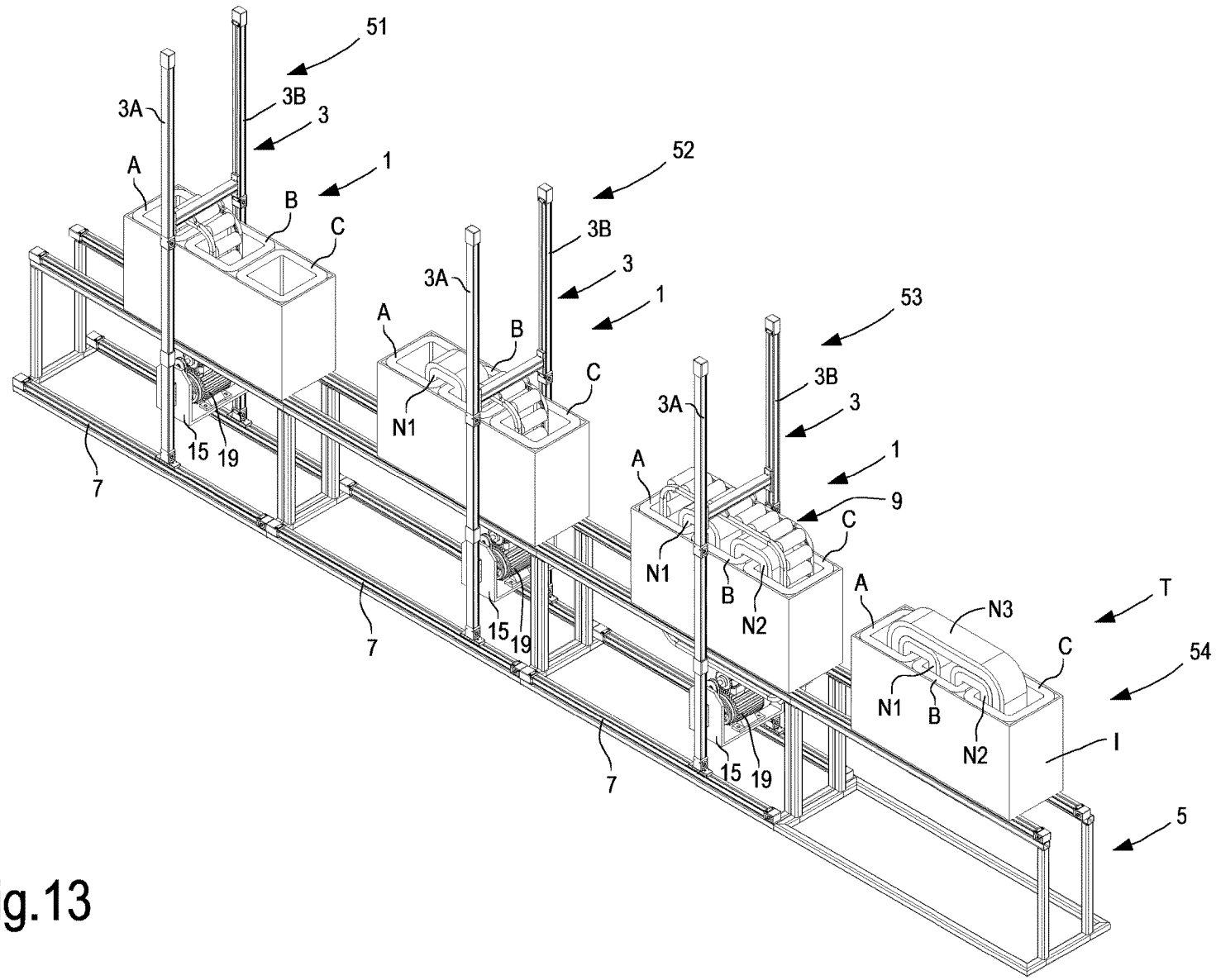
FIGS. 13 and 14 are an axonometric view and a side view, respectively, of a multiple-stations modified embodiment of a device according to the invention.
Figure 14:
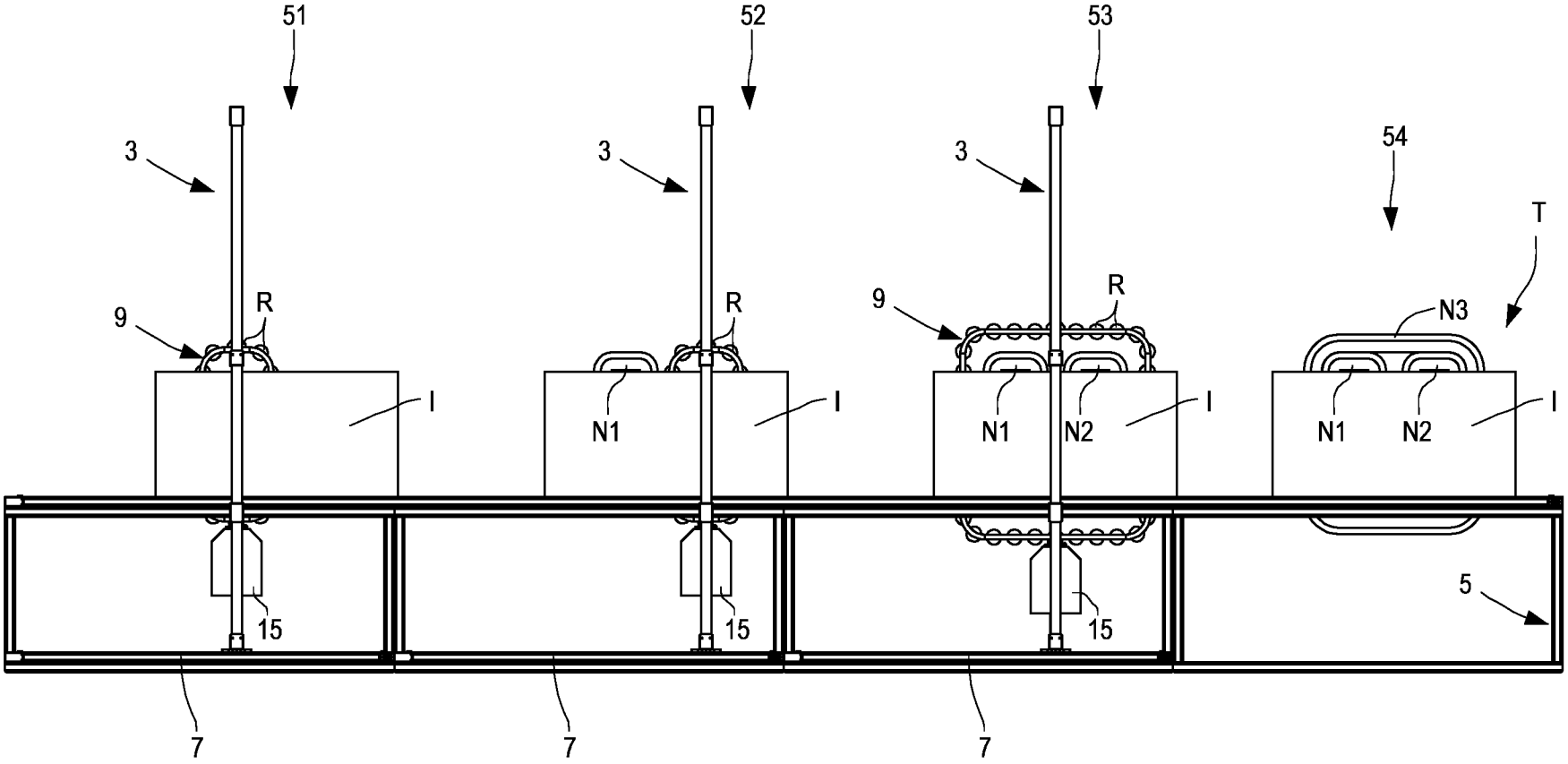

FIGS. 13 and 14 show a different embodiment of a device according to the invention. FIG. 13 is an axonometric view of the device, and FIG. 14 a side view thereof. In this embodiment the device is essentially comprised of one or more stations and includes a support, indicated again with 5, on which the transformer being assembled can translate from a first station 51 to a last station 54, passing through intermediate stations 52 and 53. A device 1, substantially like that described above, is provided in each station 51, 52, 53, wherein the various devices 1 have, in this embodiment, a common support 5 for the windings, indicated again with A, B, C in the embodiment of FIGS. 13 and 14. Essentially, the support 5 forms a translation plane for the transformer in the various assembly steps. Transport systems may be provided along the support 5, for example a conveyor, or sliding guides with pushing systems or the like, to facilitate the motion of the transformer from one to the other of the stations 51, 52, 53, 54.

In each station 51, 52, 53 one of the three ferromagnetic cores N1, N2 and N3 is formed by winding a strip-shaped ferromagnetic material. More in particular, in the station 51 the ferromagnetic core N1 forms; in the station 52 the ferromagnetic core N2 forms; in the station 53 the ferromagnetic core N3 forms, surrounding, along a path linked to the windings A and C, the ferromagnetic cores N1 and N2 formed in the winding stations 51 and 52. In the station 54 the transformer is complete. It is surrounded, just by way of example, by a case I for protecting the electrically conductive windings A-C. The transformer T passes from the station 54 to a drying and polymerizing oven, where consolidation occurs of the resin applied to the strips of ferromagnetic material M1-M18 used for the formation of the three cores N1, N2 and N3. Alternatively, polymerization may be performed at ambient temperature.

In both the embodiments, the winding consolidation may occur also using a different energy source, other than heat, for example UV rays or the like.

Instead of a linear guide with continuous flexible members guided inside it, other winding systems may be provided, provided that they can be demounted so as to be removed from the respective electrically conductive windings A, B, C, to which the respective core of ferromagnetic material N1, N2, N3 is linked.

In the illustrated embodiments, the electrically conductive windings A, B and C are arranged adjacent to one another, so as to form a linear structure. It is also possible to produce transformers, where the ferromagnetic circuit is formed by three cores arranged like a triangle, with a consequent triangle arrangement of the electrically conductive windings, according to a structure known, for example, from the publications mentioned in the introductory part of the present description. However, the arrangement illustrated in the attached figures, with the three electrically conductive windings A, B, C arranged linearly, i.e. aligned to one another, is strongly preferred, as the formation of the ferromagnetic cores N1, N2, N3 and therefore of the overall ferromagnetic circuit is made easier, exploiting in an optimal manner the inner spaces between the electrically conductive windings.

While the particular embodiments of the invention described above have been shown in the drawing and described integrally in the description above with features and characteristics relating to different example embodiments, those skilled in the art will understand the modifications, changes and omissions are possible without however departing from the innovative learning, the principles and the concepts described above and the advantages of the object described in the attached claims.

Figure 15:
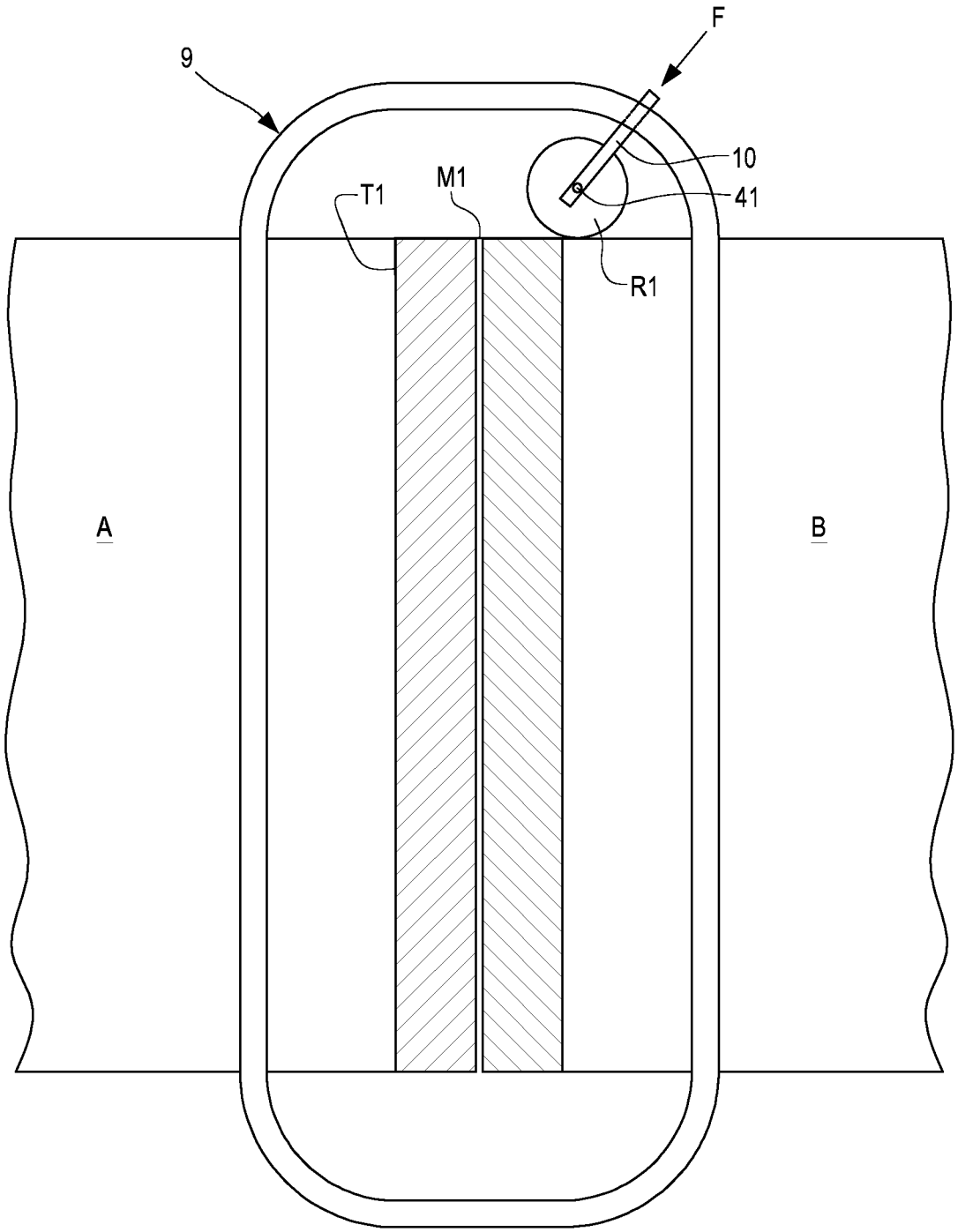
FIG. 15 shows a modified embodiment.

For example, in some embodiments each coil R1-R18 moves not only along the closed path linking the electrically conductive windings together, but also in radial direction, i.e. in a direction towards and away from the center of the path. This can be provided, for example, by arranging each of the pins 41 supporting the coils R1-R18 on auxiliary guides orthogonal to the closed path and directed towards the center thereof. The pins 41, or other suitable supports, move along the auxiliary guides so as to be always kept in the position nearest to the center of the closed path, this position varying as the thickness of the ferromagnetic core increases. The formation of the turns of ferromagnetic strip causes a gradual movement of the coils R1-R18 away from the center of the closed path. FIG. 15, similar to FIG. 10 described above, schematically shows an arrangement of this type, illustrated for only one coil R1. Number 10 indicates an auxiliary guide for the pin 41, on which the coil R1 is supported. The pin 41 is biased according to the arrow F, for instance by means of springs inserted in the auxiliary guide 10, so as to keep the outer surface of the coil R1 into contact initially with the electrically conductive windings and then with the outer surface of the ferromagnetic core being wound.

In this way, the bulks are further reduced and the available spaces are better exploited.

The invention claimed is:

1. A device for producing a transformer comprising:

a linear guide configured and arranged so as to define a closed path configured to be linked to two electrically conductive windings of a transformer; and a flexible conveyor configured to be arranged along the linear guide and move along the linear guide, the flexible conveyor being further configured to be closed, so as to form a continuous flexible conveyor extending along the linear guide when the linear guide is arranged to form the closed path linked to the electrically conductive windings, and to be opened, so as to be removed from the electrically conductive windings after the ferromagnetic core has been formed, wherein along said path at least one strip-shaped ferromagnetic material can be wound from at least one coil of ferromagnetic material.

2. A device according to claim 1, wherein one or more coils of strip-shaped ferromagnetic material can be moved along the closed path linked to said two electrically conductive windings, so as to unwind the strip-shaped ferromagnetic material from the at least one coil and to form the ferromagnetic core linked to the two electrically conductive windings.

3. A device according to claim 1, wherein the linear guide comprises at least two portions that can be coupled to each other, to form the closed path linked to the two electrically conductive windings, and can be released from one another, to remove the linear guide after the ferromagnetic core has been formed, and wherein the at least two portions are adapted in one or more of shape and size to one or more of a shape and size of the electrically conductive windings, the linear guide comprising at least another two portions to provide four portions that can be coupled to, and released from, one another, and the four portions comprise a lower portion, an upper portion, and two intermediate portions, the intermediate portions being substantially rectilinear.

4. A device according to claim 1, wherein the continuous flexible member comprises two or more portions that can be released from, or coupled to, one another to form a continuous flexible member.

5. A device according to claim 1, further comprising a motor to move the at least one coil of strip-shaped ferromagnetic material along the closed path linked to the electrically conductive windings.

6. A device according to claim 1, further comprising a support for the electrically conductive windings, and at least one support frame for supporting the linear guide, wherein said support frame can be configured so as to adapt the closed path linked to the electrically conductive windings, wherein the support frame for the guide members supports a motor to move the at least one coil of strip-shaped ferromagnetic material along the closed path linked to the electrically conductive windings.

7. A device according to claim 6, wherein the at least one support frame supporting the linear guide and the support for the electrically conductive windings are movable with respect to each other or the device further comprises another support frame to provide a plurality of support frames for the linear guide, wherein respective linear guides can be associated with each of said support frames and wherein with each support frame there is combined a respective motor to move the at least one coil along a closed path defined by the respective linear guide, linked to the electrically conductive windings, the transformer being transferred from one of the support frames to another one of the support frames.

8. An electric transformer comprising:

at least a first electrically conductive winding and a second electrically conductive winding adjacent to each other, each of the first electrically conductive winding and the second electrically conductive winding being formed by conductors wound so as to form respective coils, and at least a first ferromagnetic core comprising a plurality of strips of ferromagnetic material, each of the strips of ferromagnetic material having an initial edge and a final edge, each of the strips of ferromagnetic material forming a plurality of continuous turns, the continuous turns of single strips of ferromagnetic material being interposed between one another, such turns of different strips of ferromagnetic material are arranged over one another and interposed between one another, and the first ferromagnetic core being linked to the first electrically conductive winding and to the second electrically conductive winding.

9. A transformer according to claim 8, wherein the first ferromagnetic core is directly supported by the first electrically conductive winding and by the second electrically conductive winding.

10. A transformer according to claim 8, wherein the ferromagnetic material is an amorphous material comprising an iron-based alloy containing boron, the amorphous material having a thickness comprised between 0.01 and 0.02 mm.

11. A transformer according to claim 8, further comprising an electrically insulating hardening substance comprising a polymerized resin, between adjacent turns formed by the strips of ferromagnetic material and/or outside the cores.

12. A transformer according to claim 8, further comprising a third electrically conductive winding, a second ferromagnetic core linked to the second electrically conductive winding and to the third electrically conductive winding, and a third ferromagnetic core linked to the first electrically conductive winding and to the third electrically conductive winding, each of the second ferromagnetic core and the third ferromagnetic core comprising a plurality of strips of ferromagnetic material, each of the plurality of strips of ferromagnetic material having an initial edge and a final edge, each of the plurality of strips of ferromagnetic material forming a plurality of continuous turns, and the turns of the single strips of ferromagnetic material being interposed between one another.

13. A device for forming a ferromagnetic core which links at least two electrically conducting windings of an electric transformer, the device comprising;

a linear guide configured to define a closed path extending through the electrically conductive windings of the transformer, wherein the linear guide comprises at least two portions configured to be coupled to each other to form the closed path and to be decoupled from one another to be removed from the transformer after the ferromagnetic core has been formed; and a flexible conveyor member configured to move along the closed path defined by the linear guide.

14. A device according to claim 13, wherein the flexible conveyor member has two ends configured to be engaged to one another to form an endless conveyor, and disengaged from one another to remove the flexible conveyor member from the transformer after the ferromagnetic core has been formed.

15. A device according to claim 13, wherein the flexible conveyor member comprises at least one coil support configured to support a coil of strip-shaped ferromagnetic material.

16. A device according to claim 13, wherein the flexible conveyor member comprises a plurality of coil supports configured to support a plurality of coils of strip-shaped ferromagnetic material.

* * * * *